United States Patent [19]

Luke

[11] Patent Number: 4,478,229

[45] Date of Patent: Oct. 23, 1984

[54] SMOKE FILTERS

[75] Inventor: John A. Luke, Hampshire, England

[73] Assignee: Brown & Williamson Tobacco Corporation, Louisville, Ky.

[21] Appl. No.: 464,309

[22] Filed: Feb. 7, 1983

[51] Int. Cl.[3] ..... A24F 3/04

[52] U.S. Cl. ..... 131/336

[58] Field of Search ..... 131/336, 339, 340, 198 R, 131/198 A

[56] References Cited

U.S. PATENT DOCUMENTS 4,256,122 3/1981 Johnson ..... 131/339

*Primary Examiner*—V. Millin

*Attorney, Agent, or Firm*—Charles G. Lamb

[57] ABSTRACT

A smoke filter for a smoking article (e.g. a cigarette) comprises a filter plug having ducts extending partway along the plug from the mouth end thereof, and opening in register with inlets through wrapping means around the plug to provide segregated peripheral venting of the filter.

Further apertures in the wrapping means communicate directly with the filter plug away from the ducts to permit ambient air to enter the filter plug to mix with and dilute the smoke being filtered within the plug.

18 Claims, 4 Drawing Figures

SMOKE FILTERS

DESCRIPTION

This invention relates to smoke filters for use with smoking articles, cigarettes for example.

A number of proposals have heretofore been made for cigarette filters having provision for the ingress of ventilation air into ducts extending at the periphery of the filter to the mouth end thereof and serving to convey the air to the smoker's mouth without any, or substantially any, mixing of the air within the filter with tobacco smoke drawn through the filter. Such mode of filter ventilation may be referred to as "segregated peripheral ventilation".

It has been claimed for segregated peripheral ventilation filters that they enhance the quality of the tobacco smoke as perceived by the smoker.

The present invention provides a smoke filter comprising a rod-like plug of filtration material and having at least one airflow duct extending along said plug between a first end of the duct open at the mouth end of said plug and a second end open at the periphery of said plug; and wrapping means enwrapping said plug and permitting the ingress of a first stream of ambient air into said at least one airflow duct at a location spaced from said first end and permitting the ingress of a second stream of ambient air directly into the interior of said plug.

Preferably the ingress of said first stream of ambient air into the duct is independent of the ingress of a second stream of ambient air directly into the interior of said plug. More preferably the at least one airflow duct extends short of the other end of the plug. Advantageously, the wrapping means, or an outer layer thereof underlain by an air-permeable layer, is provided with first and second ventilation perforations for passage therethrough of the first and second streams of air respectively. Suitably, the second ventilation perforations are located over a region of the periphery of the filter plug longitudinally spaced from a region thereof at which extend the airflow ducts. Conveniently, the airflow duct is partly defined by a number of grooves in the peripheral surface of the filter plug, as well as by the wrapping means or inner layer thereof. The grooves may extend parallel to the axis of the filter plug or may be helical. There may be two sets of helical grooves of opposite hand so that the grooves of one set intersect the grooves of the other set.

The plug of filtration material may be other than of unitary form. For example, it may comprise two abutting sub-plugs, in which case one sub-plug may be provided with grooves bounding the airflow duct.

By use of a filter according to the invention on a cigarette, an unexpected improvement in the taste of the mainstream smoke is obtainable over that perceived when a filter is employed of which the only mode of ventilation is segregated peripheral ventilation.

Figure 1:
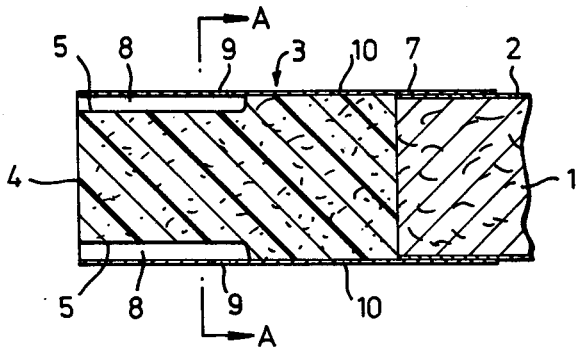
Figure 1A:
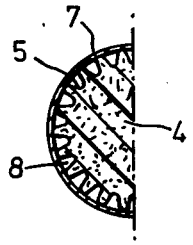
Figure 2:
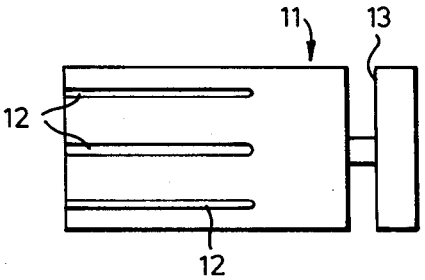
Figure 3:
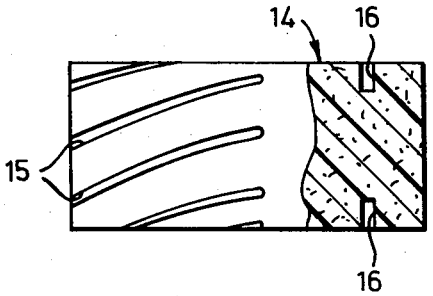

In order that the invention may be clearly understood and readily carried into effect, reference will now be made, by way of example, to the accompanying diagrammatic drawing, in which:

FIG. 1 shows a part view, in axial section, of a filter-tipped cigarette;

FIG. 1*a* shows a cross-sectional view of half of the cigarette of FIG. 1 taken along line A—A thereof;

FIG. 2 shows a filter plug of an alternative form from that of the cigarette of FIG. 1; and FIG. 3 shows, partially in axial section, a further alternative form of filter plug.

The cigarette of FIG. 1 comprises a rod 1 of cut tobacco enwrapped in cigarette paper 2, and a filter 3 comprising a self-sustaining filter plug 4 of fibrous cellulose acetate filtration material. At the periphery of the plug 4 there extend a series of grooves 5—see also FIG. 1*a*. The grooves 5 open at the mouth end of the plug 4 and extend parallel to the plug axis for about half the length of the plug 4. A convenient method of forming the grooves 5 is to subject the plug 4, or preferably a piece of filter rod material from which several of the plugs 4 are to be cut, to a hot moulding process such as, for example, that disclosed in U.K. Patent Specification No. 1,507,765. Sealing of the walls of the grooves 5 may be assured by the application thereto of a sealant material, polyethylene for instance.

Serving to secure the filter 3 to the cigarette rod 1, 2 is a tipping 7. In the portions where it overlies the grooves 5, the tipping 7 defines, together with the walls of the grooves 5, airflow ducts 8. In the tipping 7 are two rows of ventilation perforations 9 and 10. As is indicated in FIG. 1, the row of perforations 9 encircles the plug 4 at that portion thereof at which the grooves 5 extend, the arrangement being such that at least one of the perforations 9 is in communication with each of the airflow ducts 8. The row of perforations 10 encircles a portion of the plug 4 into which the grooves 5 do not extend.

The perforations 9 and 10 may, if desired, be formed as micro-perforated regions of the tipping 7.

It is also possible for the tipping 7 to overlie a plug wrapper of air-pervious quality in which case the tipping serves as an outer layer in which the ventilation perforations are provided.

A further alternative is for the tipping 7 to overlie an impervious plug wrapper, in which case the wrapper would be provided with perforations in-register with the perforations 10 in the tipping 7. Suitably in such latter case the plug wrapper perforations would be formed at the same time as the perforations 10, mechanically or by laser drilling.

When the cigarette of FIG. 1 is smoked, ambient air is drawn in through the perforations 10 directly into the filter plug 4 and mixes with tobacco smoke passing through the latter. Ambient air is also drawn in separately through the perforations 9 into the airflow ducts 8 and passes along the ducts to the outlet ends thereof unmixed, or substantially unmixed, with smoke.

The filter plug shown in FIG. 2 and generally designated 11 is one which may be used in place of the plug 4 of FIG. 1. The plug 11 is provided with a number of equally-spaced longitudinal grooves 12 which open at the mouth end of the plug and extend therefrom for substantially less than the full length of the plug. In a portion of the plug 11 clear of the longitudinal grooves 12 the plug is provided with a deep annular circumferential channel 13. The longitudinal grooves 12 and circumferential channel 13 may conveniently be formed by a hot moulding process. When the plug 11 is incorporated in a filter-tipped cigarette, it is enwrapped in a wrapping which is constructed to permit the ingress of a first stream of air directly into airflow ducts bounded by the walls of the longitudinal grooves 12 and by the inwardly facing surface of the wrapping, and a second, separate stream of air into the circumferential channel 13. The second stream of air directly enters the interior of the plug 11, mainly through the downstream side wall of the circumferential channel 13.

If a tipping wrapper surrounding the filter plug 11 is provided with a row of perforations (like the perforations 9 of FIG. 1) in register with the portion of the plug in which the longitudinal grooves 12 extend and if some intermediate ones of the perforations in that row are disposed between the longitudinal grooves, air may be prevented from entering the interior of the plug 11 through such intermediate perforations by applying a sealant to the peripheral surface of the plug 11. Alternatively, the plug 11, or a piece of filter rod of which the plug 11 initially formed part, may be enwrapped in a non-permeable wrapper of thermoplastic character prior to being hot-moulded to provide the longitudinal grooves 12 and the circumferential channel 13. In the latter case the hot-moulding of the comparatively shallow longitudinal grooves 12 leaves the non-permeable wrapper substantially intact, whereas little or no remnant of the wrapper is observable in the deep circumferential channel 13. Thus the walls of the longitudinal grooves 12 are air-impermeable and at least the side walls of the circumferential channel 13 are air-permeable.

FIG. 3 shows another form of filter plug, generally designated 14, which may be used in place of the plug 4 of FIG. 1. Plug 14 is provided with a number of equally-spaced, helical grooves 15 which extend from the mouth end of the plug 14 and may be formed by a hot-moulding process. Plug 14 is also provided, clear of the grooves 15, with a number of holes 16 extending radially inwardly from the peripheral surface of the plug. The holes 16 may be formed mechanically or by a laser, formation of the holes conveniently taking place after assembly of the plug 14 with a cigarette rod so that the step of forming the holes 16 also results in the perforation of the wrapper.

Although the above described filter plugs are of a unitary nature, dual element plugs could be used, such that a first element has grooves formed in it extending from the mouth end of the first element, and the second element has means for permitting the ingress of air into the interior of the second element. The grooves in the first element could extend for the full length of the first element. If such dual element plugs are wrapped in respective plug wrappers, conveniently the wrapper of the first element is air-impervious and that of the second element is air-pervious.

The air/smoke regime issuing from each of the above described filters, as far as it is due to the segregated peripheral ventilation, is modified by the establishment within the filter of an air/smoke flow by virtue of the direct ventilation air flow into the interior of the filter plug. This modification effect results in an unexpected improvement in the taste of the mainstream smoke.

The various perforations 9, 10 and 11 shown in the drawing are not to scale and are exaggerated for ease of illustration.

I claim:

1. In a smoke filter comprising:

(a) rod-like filter plug means of filtration material having a mouth end and a distal end;

(b) airflow duct means extending along said filter plug means and having a first end open at said mouth end of said filter plug means and a second end open at the periphery of said filter plug means spaced from said mouth end thereof;

(c) air impervious wrapping means enwrapping said filter plug means; and (d) first air ingress means at a location along said airflow duct means spaced from said first end thereof effective to permit the ingress of a first stream of ambient air into said airflow duct means at said location; the improvement comprising (e) second air ingress means being separate from and distinct in location from said first air ingress means effective to permit the ingress of a second stream of ambient air directly into the interior of said filter plug means spaced from said location along said airflow duct means.

2. A filter according to claim 1, wherein said second air ingress means are effective to permit the ingress of said second stream of ambient air independently of the ingress of said first stream of ambient air.

3. A filter according to claim 1, wherein said second end of said airflow duct means is between and spaced from the ends of the filter plug means.

4. A filter according to claim 1, wherein first and second air ingress means comprise first and second ventilation perforation means of said wrapping means to pass the respective first and second streams of ambient air.

5. A filter according to claim 4, wherein said filter plug means comprises a first region along which said one airflow duct means extend and a second region which is spaced longitudinally from said first region and around which said second ventilation perforation means are located.

6. A filter according to claim 5, and including circumferentially extending channel means in the filter plug means at said second region; said circumferentially extending channel means being in register with said second ventilation perforation means, and being effective to admit said second stream of air directly into the interior of the filter plug means.

7. A filter according to claim 4, wherein said ventilation perforation means comprise micro-perforated regions of the wrapping means to permit the ingress of at least one of said first and second streams of ambient air through the wrapping means.

8. A filter according to claim 1, wherein said wrapping means comprise a generally air-permeable inner layer and a less permeable outer layer, and wherein said first and second air ingress means comprise first and second ventilation perforation means of the outer layer to pass the respective first and second streams of ambient air.

9. A filter according to claim 1, wherein said airflow duct means comprise a plurality of said airflow ducts equiangularly spaced around the periphery of said filter plug means.

10. A filter according to claim 9, wherein said filter plug means includes means defining a plurality of longitudinal surface grooves, wherein said wrapping means has a radially inwardly facing surface contiguous to said filter plug, and wherein each said airflow duct is defined partly by a respective one of said grooves and also partly by said radially inwardly facing surface of said wrapping means.

11. A filter according to claim 1, wherein said filter plug means comprises two abutting sub-plugs, one of said sub-plugs including said airflow duct means, and the other said sub-plug being devoid of said airflow duct means.

12. A filter according to claim 1, wherein said airflow duct means comprise a plurality of airflow ducts extending helically of said filter plug means starting from said mouth end thereof.

13. In a smoke filter comprising:

(a) rod-like filter plug means of filtration material having a mouth end and a distal end;

(b) airflow duct means extending along said filter plug means and having a first end open at said mouth end of said filter plug means and a second end open at the periphery of said filter plug means spaced from said mouth end thereof;

(c) air impervious wrapping means enwrapping said filter plug means; and (d) first ventilation perforation means permitting the ingress of a first stream of ambient air into said airflow duct means at said second end thereof;

the improvement comprising (e) second ventilation perforation means effective to permit the ingress of a second stream of ambient air independently of said first stream, directly into the interior of said filter plug means; wherein said filter plug means comprises a first region including said airflow duct means and around which said first ventilation perforation means are disposed, and a second region devoid of said airflow duct means and around which said second ventilation perforation means are arranged, said first and second regions being axially consecutive.

14. A filter according to claim 13, and including circumferentially extending channel means in the filter plug means at said second region; said circumferentially extending channel means being in register with said second ventilation perforation means, and being effective to admit said second stream of air directly into the interior of the filter plug means.

15. A filter according to claim 13 wherein said ventilation perforation means comprise micro-perforated regions of the wrapping means to permit the ingress of at least one of said first and second streams of ambient air through the wrapping means.

16. A filter according to claim 13, wherein said airflow duct means comprise a plurality of airflow ducts extending helically of said filter plug means starting from said mouth end thereof.

17. In a smoke filter comprising:

(a) rod-like filter plug means of filtration material having a mouth end and a distal end;

(b) a plurality of airflow ducts equiangularly spaced around said filter plug means and each extending along said filter plug means from a first end open at said mouth end of said filter plug means to a second end open at the periphery of said filter plug means, said second end of each airflow duct being spaced from said mouth end of the filter plug means;

(c) air impervious wrapping means enwrapping said filter plug means and having a radially inwardly facing surface contiguous therewith; and (d) means defining first ventilation perforations of said wrapping means overlying said second ends of said airflow ducts;

the improvement comprising:

(e) means defining second ventilation perforations overlying said filter plug means and remote from said airflow ducts thereof, said second ventilation perforations being effective to permit the ingress of a second stream of ambient air directly into the interior of said filter plug means independently of said ingress of the first stream of ambient air into said airflow ducts; and (f) means defining a plurality of longitudinally extending surface grooves to said filter plug means; whereby said wrapping means radially inwardly facing surface contiguous to said filter plug partly defines said airflow ducts and said surface grooves of the filter plug means also partly define said airflow ducts.

18. A filter according to claim 17, wherein said airflow ducts extend helically of said filter plug means starting from said mouth end thereof.

* * * * *